US006870451B1

(12) United States Patent
Inoue

(10) Patent No.: US 6,870,451 B1
(45) Date of Patent: Mar. 22, 2005

(54) MANUAL TRIPPING DEVICE FOR MAGNETIC OPERATING MECHANISM

(75) Inventor: Naoaki Inoue, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/859,075

(22) Filed: Jun. 3, 2004

(30) Foreign Application Priority Data

Jan. 7, 2004 (JP) ..... 2004-002358

(51) Int. Cl.[7] ..... H01H 9/00

(52) U.S. Cl. ..... 335/172; 335/173; 335/238

(58) Field of Search ..... 335/6, 23, 27, 335/35, 172–180, 228–234, 238, 253

(56) References Cited

U.S. PATENT DOCUMENTS 4,583,066 A * 4/1986 Howell ..... 335/229
4,891,994 A * 1/1990 Barba ..... 74/2

FOREIGN PATENT DOCUMENTS

JP 08-055531 A 2/1996

* cited by examiner

*Primary Examiner*—Ramon M. Barrera
(74) *Attorney, Agent, or Firm*—Sughrue Mion, PLLC

(57) ABSTRACT

A manual tripping device for a magnetic operating mechanism is provided with a connecting body which is connected with an operating rod of the magnetic operating mechanism at the time of manual operation for the switches, a spring compressing shaft one end of which is movably engaged to the connecting body to compress spring means, and a rotating shaft which is engaged to the other end of the spring compressing shaft with the spring compressing shaft being movable within the given range, and which is rotated with a handle.

9 Claims, 4 Drawing Sheets

( a )

( b )

MANUAL TRIPPING DEVICE FOR MAGNETIC OPERATING MECHANISM

BACKGROUND OF THE INVENTION

1. Field of the Invention

The present invention relates to a magnetic operating mechanism for switches, particularly, relates to a manual tripping device for the magnetic operating mechanism.

2. Description of Related Art

In the switches, such as vacuum switches and the like, used in a power transportation or distribution system, a magnetic operating mechanism in which permanent magnets are implemented has generally been used for the switching operation. The magnetic operating mechanism makes an opening/closing operation of contacts in the switches using electromagnetic force based on magnetic fields, which are generated by discharging electric energies charged in capacitors previously from a power source. After the switching operation, the opened or closed position in the switches is entirely held by electromagnetic force based on magnetic fields of the permanent magnets.

The above described switches having such the magnetic operating mechanism are needed to open the contacts manually when the power supply is interrupted by the reason of power suspension, for instance.

Japanese Patent Publication (non-examined) 55531/1996 describes an example of such a conventional manual operating device in which a tripping mechanism is used to engage or disengage a latch pin and a latch lever. In the normal condition, an opening operation is made by exciting the coil of a tripping magnet, but in the abnormal condition such as power failures, the opening operation is done manually through a pulling-in lever by rotating a handle attached on manually-operable shaft.

However, the conventional mechanism mentioned above requires for extremely complicate structure consisting of many parts. In addition, switch gears in which the switches are installed are used in a parallel arrangement of a plurality of units in many cases, so that each switch must be provided with such tripping mechanism. Therefore, manufacturing process is complicated due to the increase in the number of parts, and the operating device is upsized by parallel arrangement of the plurality of units, resulting in increase in a manufacturing cost.

SUMMARY OF THE INVENTION

In view of the foregoing, an object of the present invention is to overcome problems mentioned in the conventional structures.

Another object of the present invention is to provide a manual tripping device for the magnetic operating mechanism that can reduce the number of parts by which the switches are constructed and simplify the manufacturing process.

A further object of the present invention is to provide a manual tripping device for the magnetic operating mechanism that can be downsized and cost-reduced.

A still further object of the present invention is to provide the manual tripping device for the magnetic operating mechanism that achieves a simple and reliable tripping operation and secures a safety in the operation.

According to one aspect of the present invention, the manual tripping device for the magnetic operating mechanism in which an opening/closing operation of the switches is performed by electromagnetic forces, and the opened or closed position of the switches is held by the permanent magnets, includes: a connecting body which is connected with an operating rod of the magnetic operating mechanism at the time of manual operation of the switches; a spring compressing shaft one end of which is movably engaged to the connecting body to compress spring means; and a rotating shaft which is connected to the other end of the compressing shaft so that the compressing shaft is movable to the given range, and which is rotated with a handle.

BRIEF DESDCRIPTION OF THE DRAWINGS

The above objects and advantages of the present invention will become apparent from the following detailed description of the preferred embodiments when read in connection with the accompanying drawings, which are given by way of illustration only, wherein like reference numerals designate like or corresponding parts throughout the several views.

FIG. 1(*a*) through FIG. 1(*c*) each is a front view showing a total construction of a manual tripping device for a magnetic operating mechanism according to a first preferred embodiment of the invention.

FIG. 2(*a*) and FIG. 2(*b*) are a sectional view showing a detail construction of the manual tripping device according to the first preferred embodiment shown in FIG. 1.

DETAILED DESCRIPTION OF THE PREFERRED EMBODIMENTS

Embodiment 1.

Figure 1:
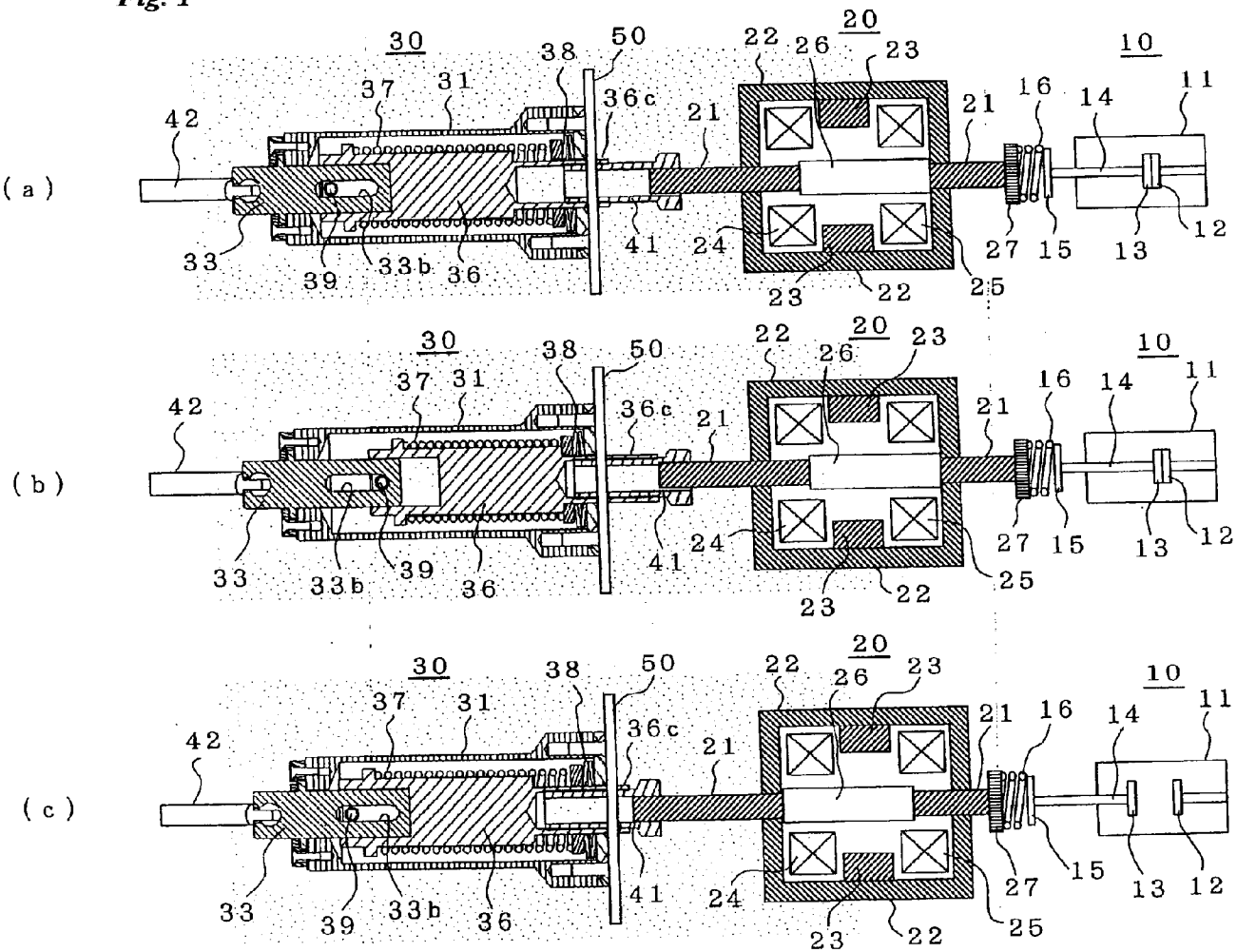

FIG. 1(*a*) through FIG. 1(*c*) each is a front view showing a construction of a manual tripping device for a magnetic operating mechanism according to a first preferred embodiment of the invention. FIG. 1(*a*) is a sectional view showing a closing state of the switch, FIG. 1(*b*) showing a compressing state of a spring means, and FIG. 1(*c*) showing an opening state of the switch.

In the drawings, reference numeral 10 designates the switch such as a vacuum switch and the like, having a fixed contact 12 and a movable contact 13 in the vacuum valve 11. The movable contact 13 is supported on one end of a main shaft 14 and is movable in the axial direction. The compressed spring 16 gives a compressed pressure necessary to the movable contact 13 through a collar 15 provided to the other end of the main shaft 14. Reference numeral 20 denotes a magnetic operating mechanism for the switch, in which an operating rod 21 is connected to the main shaft 14 of the switch 10 via an insulating rod 27. The magnetic operating mechanism 20 is provided with a yoke 22 laminated with a plurality of magnetic steel plates, ups and downs or back and forth. The magnetic operating mechanism 20 is also provided with permanent magnets 23 attached on the yoke 22, and a movable rod 26 attached integrally with the operating rod 21 and permitted a given travel together with the rod 21 within the yoke 22. Reference numeral 30 designates a manual tripping device which is used at the time when the power supply is interrupted by the reason of power suspension, for instance.

Figure 2:
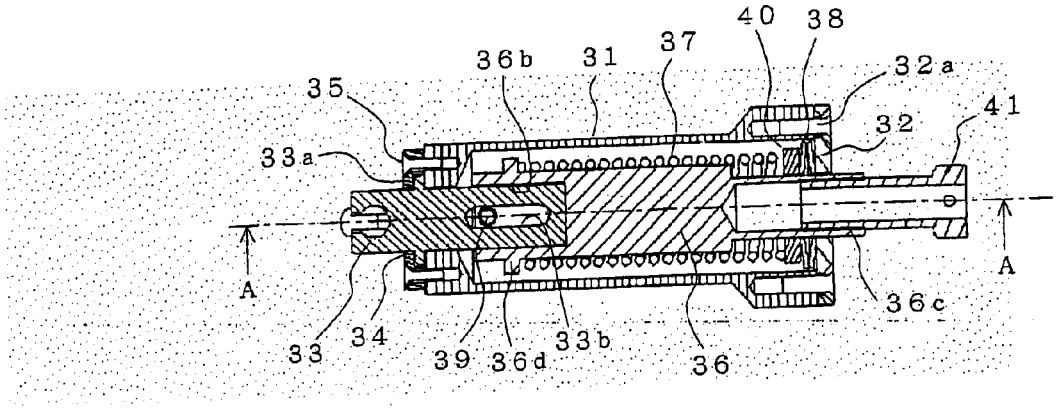
Figure 2:
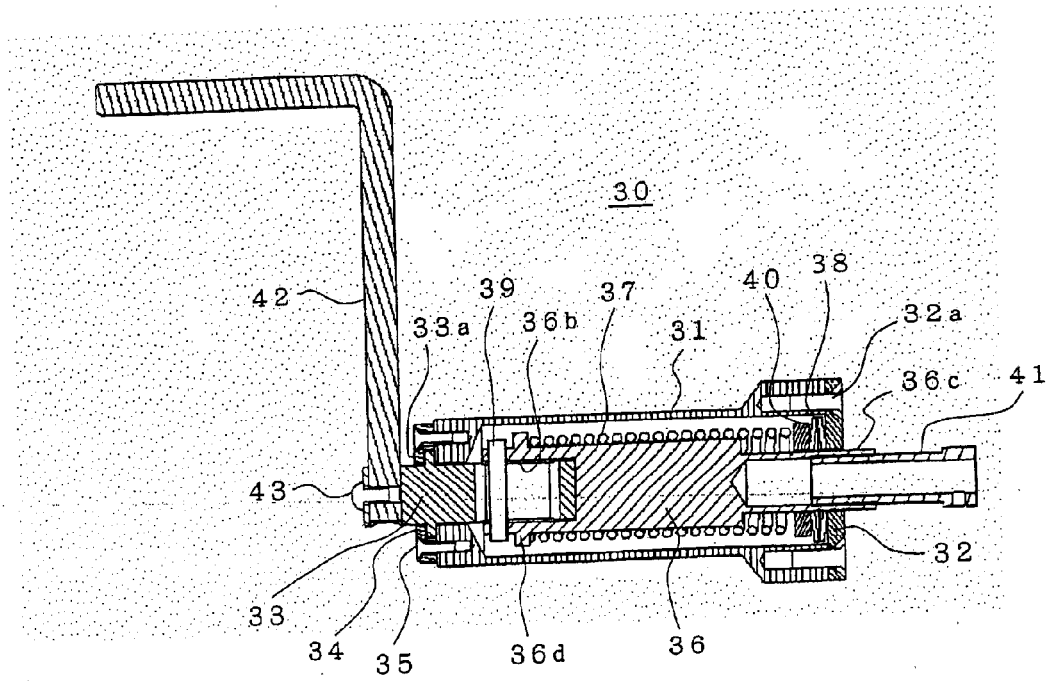

FIG. 2(*a*) and FIG. 2(*b*) show a detail structure of the manual tripping device, respectively. FIG. 2(*a*) shows a sectional plan view of the manual tripping device, and FIG. 2(*b*) shows a sectional view in the line A—A of FIG. 2(*a*).

In the figures, reference numeral 31 is a cylindrical housing, on one end of which (right side) a bottom plate 32 with a center hole is secured with a screw 32*a*, and on the other end of which (left side) a top plate 34 with a center hole is secured with a screw 35 after a rotating shaft 33 having a collar 33*a* and an elongated hole 33*b* is inserted. The collar 33*a* is covered with the top plate 34 and is secured to the cylindrical housing 31 by a screw 35.

Additionally, the cylindrical housing 31 houses a spring compressing shaft 36 which is compressed with two kind of springs, i.e., a coil spring 37 and a conical spring 38. The one end (left side) of the spring compressing shaft 36 is provided with a hole 36*b* in which the rotating shaft 33 loosely inserted, and is connected to the rotating shaft 33 by a pin 39 which passes through the elongated hole 33*b* provided in the rotating shaft 33. The connection between the spring compressing shaft 36 and the rotating shaft 33 is achieved with the both being movable each other within the span of the elongated hole 33*b*. The other end (right side) of the spring compressing shaft 36 is provided with a cylindrical body 36*c* which penetrates the bottom plate 32 through the center hole therein. A washer 40 is inserted between the coil spring 37 and the conical spring 38 disposed around the cylindrical body 36*c*. Therefore, the coil spring 37 is inserted with spring tension between the washer 40 and a spring support 36*d* of the spring compressing shaft 36, and the conical spring 38 is inserted between the washer 40 and the bottom plate 32. The cylindrical body 36*c* of which the inner surface is cut threads is threaded into the connecting rod 41 of which the outer surface is cut threads. A handle 42 is connected to the end of the rotating shaft 33 with a screw 43 and is allowed to rotate the rotating shaft 33 manually.

At the time when the manual tripping device 30 is used, the cylindrical body 36*c* and the connecting rod 41 are first inserted from outside into a face plate 50 of a panel board (not shown) in which the switch 10 and the magnetic operating mechanism 20 are installed. The operating rod 21 of the magnetic operating mechanism 20 is threaded into the inner surface of the connecting rod 41 to secure each other.

Next, the operation of the above embodiment will be described with reference to FIG. 1(*a*) through FIG. 1(*c*), and FIG. 2(*a*) and FIG. 2(*b*). At the time when the power supply is working normally, the opening and closing operation of the switch by the magnetic operating mechanism 20 is as follows. Incidentally, in this status, the manual tripping device 30 is dismounted from the face plate 50 of the panel board or remains disconnected to the operating rod 21 of the magnetic operating mechanism 20.

FIG. 1(*a*) shows the status in which the switch 11 is closed, and the movable rod 26 of the magnetic operating mechanism 20 is positioned at the right side, and both of the coils 24, are not excited. In this status, magnetic flux generated from the permanent magnet 23 passes through mainly the right side of the yoke 22 where the magnetic resistance is lower than in the opposite side because of the existence of the movable rod 26. The movable rod 26 is, hence, held at the right side position on the drawing only by the magnetic pull-in force from the permanent magnet 23.

Then, when the first coil 24 is excited by discharging energies accumulated in a capacitor not shown, the movable rod 26 is pulled in to the left side by the flux generated due to the excitation to bring the contacts 12, 13 to open as shown in FIG. 1(*c*). In this status, even though the first and second coils 24, 25 are de-energized, the moving rod 26 is held at the left side position by the magnetic pull-in force from the permanent magnet 23. In order to close the contacts 12, 13 again, the second coil 25 is excited to pull-in the moving rod 26 to the right side with the same principle as described above.

At the time when the power supply is interrupted by the reason of power suspension etc., and contacts of the switches are needed to be tripped manually, the operation of the manual tripping device 30 is as follows.

First, The parts of the cylindrical body 36*c* and the connecting rod 41 are inserted from outside into a panel board (not shown) in which the switch 10 and the magnetic operating mechanism 20 are installed, via a hole provided in the face plate 50 of the panel board. Then, the operating rod 21 of the magnetic operating mechanism 20 is threaded into the inner face of the connecting rod 41 to be secured, and the handle 42 is attached to the rotating shaft 33 by the screw 43, as shown in FIG. 1(*a*). When the handle 42 is rotated clockwise, the spring compressing shaft 36 is also rotated clockwise, because the rotating shaft 33 and the spring compressing shaft 36 are connected each other via the pin 39. During this step, the spring compressing shaft 36 actuates toward the right side on the drawing because the cylindrical body 36*c* of the spring compressing shaft 36 is threaded into the connecting rod 41. At the same time, the coil spring 37 and the conical spring 38 are compressed by the spring compressing shaft 36. This status is shown in FIG. 1(*b*). Further rotation of the handle 42 brings to the threshold level where the compressed repulsion force by the coil spring 37 and the conical spring 38 becomes equal to the magnetic pull-in force from the permanent magnet 23 described above. When the threshold level is reached, the spring compressing shaft 36 is actuated toward the left side by releasing power of the springs. As the result, the operating rod 21 and the main shaft 14, which are connected to the spring compressing shaft 36, moves together to open the switch contact 12, 13, as shown in FIG. 1(*c*). At this step, the movable rod 26 in the magnetic operating mechanism 20 is also actuated toward the left side and is held at the left side position by the flux from the permanent magnet 23. The releasing power of the coil spring 37 works in collaboration with that of the conical spring 38. The coil spring 37 operates mainly to absorb the compressed repulsion force transmitted to the spring compressing shaft 36 caused by a collision between the movable rod 26 and the yoke 22, and to deaden or stabilize the vibration of the shaft 36 promptly.

In addition, the forces generated across the coil spring 37 during the tripping operation are exerted between the spring compressing shaft 36 and the face plate 50, but are not exerted to the rotating shaft 33. This means that the handle 42 is not permitted to inversely rotate even if the operator released his or her hand by mistake. Likewise, the spring compressing shaft 36 is actuated toward the left side on the drawing during the tripping operation, but the collar 33*a* of the rotating shaft 33 is not moved in the axial direction because the collar 33*a* is secured to the top plate 34.

This can prevent the operator during all over the tripping operation from suffering injuries caused by energies compressed in the coil spring 37, securing the operator's safe. As described above, according to the preferred embodiment 1, an advantage is exhibited in that the number of parts or members constituting the switches is decreased, facilitating an easier construction or assembly, downsizing, and cost reduction of the device.

The another advantage is exhibited in that the tripping operation by the handle becomes easier and reliable, securing the operator's safe.

Embodiment 2.

Figure 3:
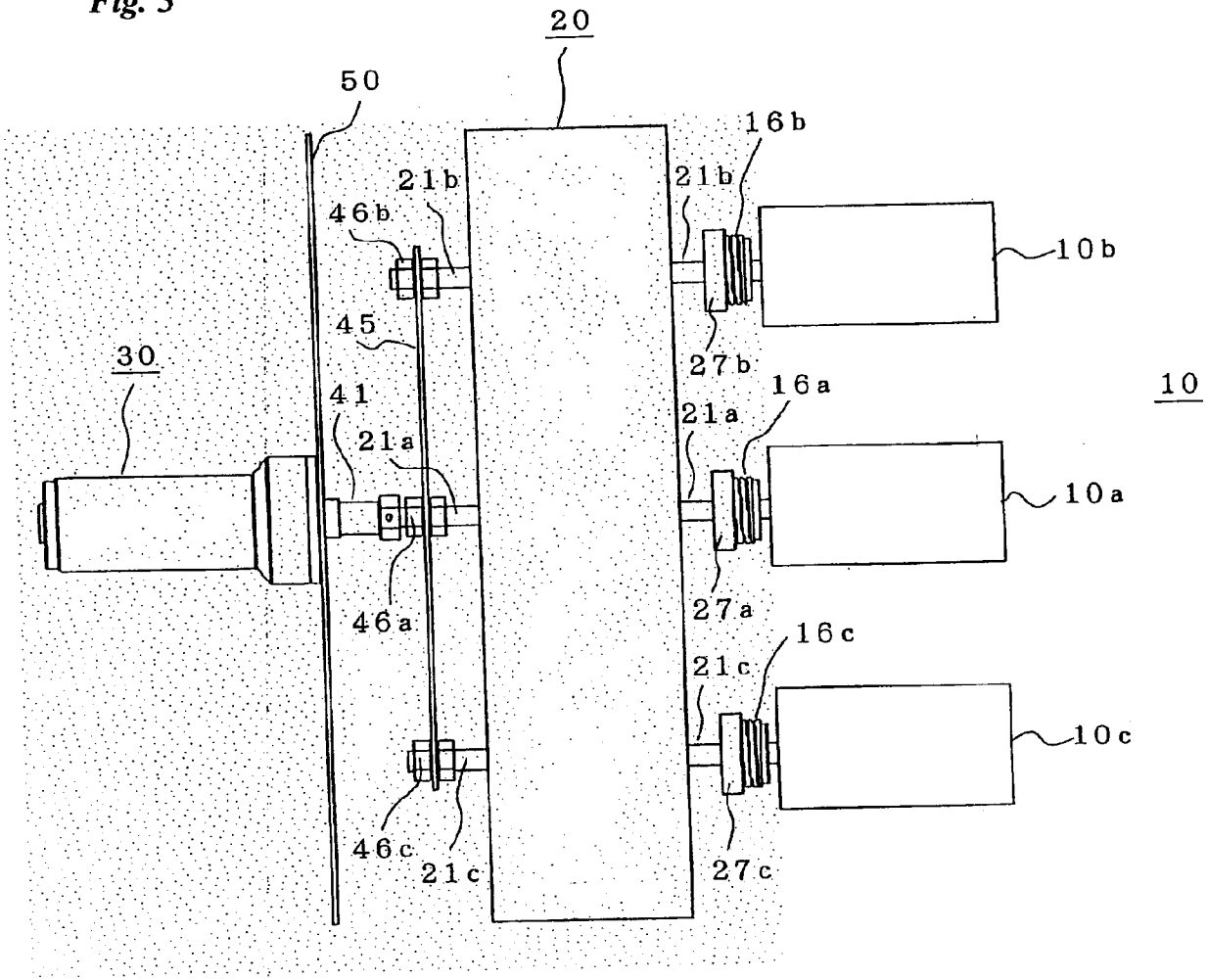
FIG. 3 is a front view showing a total construction of a manual tripping device for a magnetic operating mechanism according to a second preferred embodiment of the invention.

FIG. 3 is a plan view showing a construction of a manual tripping device for a magnetic operating mechanism in three-phase arrangements according to a second preferred embodiment of the invention.

In FIG. 3, three phase switches 10*a*, 10*b*, and 10*c* being arranged in a side-by-side configuration are connected to operating rods 21*a*, 21*b*, and 21*c* via compressed springs 16*a*, 16*b*, and 16*c*, insulating rods 27*a*, 27*b*, and 27*c*, and magnetic operating mechanism 20 (each phase is existed separately). The connecting rod 41 is threaded into the central operating rod 21*a*. The operating rod 21*a* is securely connected to the other operating rods 21*b* and 21*c* through a connecting frame 45 by tightening with connecting means 46*a*, 46*b*, and 46*c* such as nuts securely.

In such construction, the tripping operation by the manual tripping device 30 enables opening the three phase switches 10*a*, 10*b*, and 10*c* simultaneously. Because, as clear from FIG. 3, when the connecting rod 41 is moved toward the left side on the drawing, the other operating rods 21*b* and 21*c* which are connected one another via the connecting frame 45 are also moved toward the left side.

According to the second preferred embodiment, the tripping operations of three phase switches become possible at a time by a single manual tripping device. This results in that there is no need to prepare the manual tripping device to each phase respectively, contributing further to downsizing and cost reduction of the products.

Embodiment 3.

Figure 4:
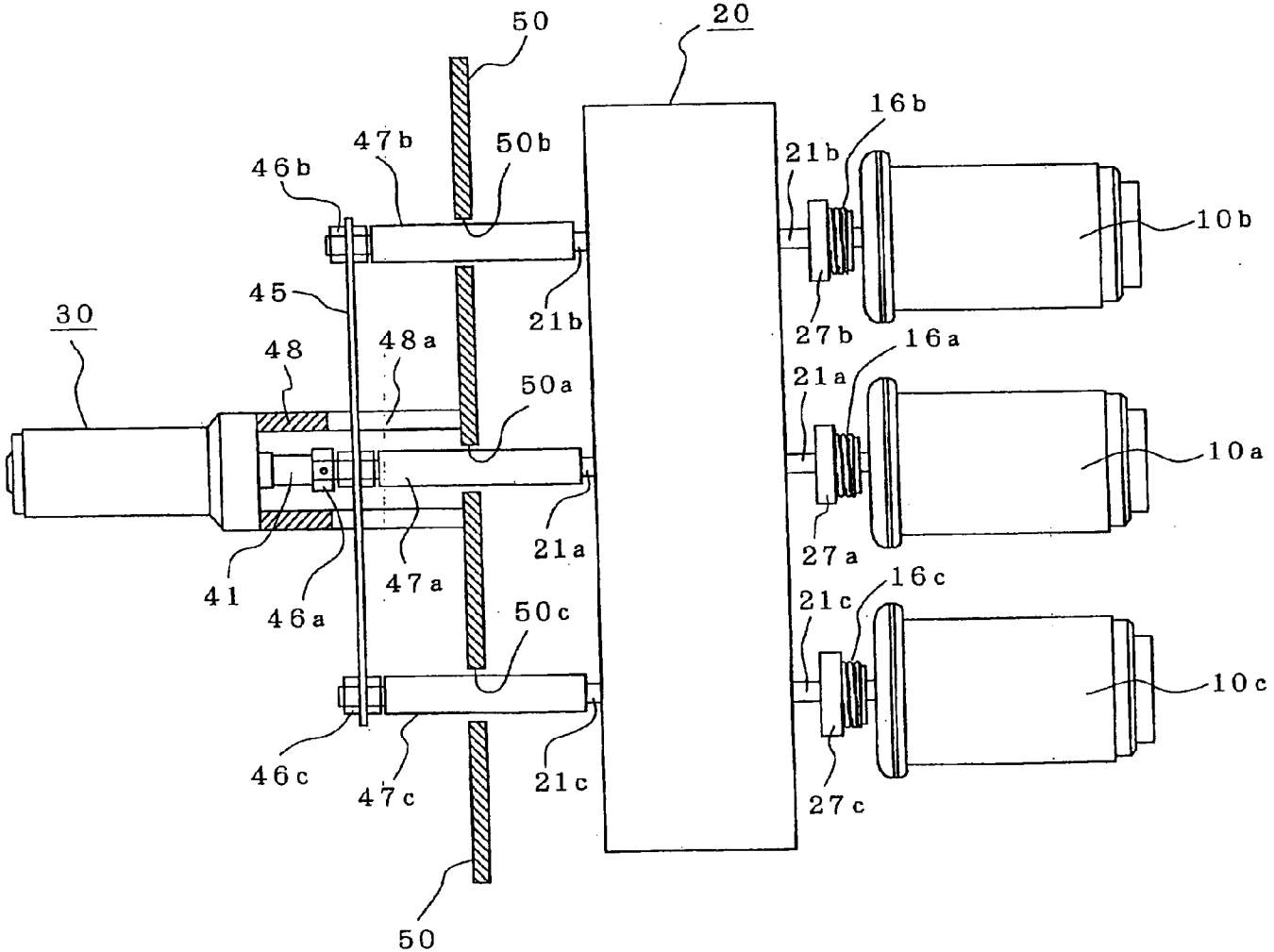
FIG. 4 is a front view showing a total construction of a manual tripping device for a magnetic operating mechanism according to a third preferred embodiment of the invention.

FIG. 4 is a plan view showing the other construction of a manual tripping device for a magnetic operating mechanism in three-phase arrangements according to a third preferred embodiment of the invention.

In FIG. 4, the operating rods 21*a*, 21*b*, and 21*c* are led out to the outside of the faceplate 50 through the connecting rods 47*a*, 47*b*, and 47*c*. When the manual tripping operation is needed, the manual tripping device 30 can be attached to the operating rods 21*a*, 21*b*, and 21*c* from outside of the panel. The connecting rod 41 of the manual tripping device 30 is connected to the central connecting rod 47*a* with the screw 46*a*. The central connecting rod 47*a* is securely connected to the other connecting rods 47*b* and 47*c* through the connecting frame 45 and connecting means 46*a*, 46*b*, and 46*c*. In order to ensure a space from the faceplate 50, the manual tripping device 30 is provided with a spacer 48 having a through hole 48*a* through which the connecting frame 45 is passed.

In the case where the handle is rotated without the spacer 48, the handle itself is likely to move toward the right side. Therefore, the handle is fixed by contacting one end of it to the faceplate 50 so that the handle is not moved toward the right side or left side, and only the spring compressing shaft 36 can be moved toward the right side as in the case of FIG. 3.

In such construction, it is possible to attach the manual tripping device 30 from the outside of the faceplate 50 at the time when the manual tripping operation is needed, such as power failure. As a result, an additional advantage is exhibited in that the manual tripping device can be set easily and instantly.

Whereas many alterations and modifications of the present invention will no doubt become apparent to a person of ordinary skill in the art after having read the foregoing description, it is to be understood that the particular embodiment shown and described by way of illustration is in no way intended to limit the scope of the claims which in themselves recite only those features regarded as essential to the invention.

What is claimed is:

1. A manual tripping device for a magnetic operating mechanism wherein an opening or closing operation for switches is performed by electromagnetic forces, and the opened or closed position of the switches is held by permanent magnets; comprising:

a connecting body which is connected with an operating rod of the magnetic operating mechanism at the time of manual operation for the switches;

a spring compressing shaft one end of which is movably engaged to the connecting body to compress spring means; and a rotating shaft which is engaged to the other end of the spring compressing shaft with the spring compressing shaft being movable within a given range, and which is rotated with a handle.

2. A manual tripping device for the magnetic operating mechanism according to claim 1, wherein said spring means comprises a coil spring and a conical spring.

3. A manual tripping device for the magnetic operating mechanism according to claim 1, wherein one end portion of the spring compressing shaft has a cylindrical part which passes through a board wall of the switch for screw-in connection with the connecting body, a clockwise rotation of the handle causing the movement of the cylindrical part of the spring compressing shaft to compress the spring means.

4. A manual tripping device for the magnetic operating mechanism according to claim 1, wherein the other end portion of the spring compressing shaft has a hole for inserting the rotating shaft in which an elongate hole extending to the axial direction is cut through, a pin being provided in the hole of the spring compressing shaft through the elongate hole, thereby the spring compressing shaft and the rotating shaft being engaged movably within the span of the elongate hole.

5. A manual tripping device for the magnetic operating mechanism according to claim 1, wherein the opening operation of the switches is initiated when the repulsion force of the spring compressed by the rotation of the handle exceeds the magnetic pull-in force from the permanent magnet (23).

6. A manual tripping device for the magnetic operating mechanism according to claim 1, wherein said switches are in three-phase arrangements, a connecting frame for moving each operating rod of the switches simultaneously is provided on the connecting portion between the connecting body and the operating rod.

7. A manual tripping device for a magnetic operating mechanism wherein an opening or closing operation for switches is performed by energies discharged from capacitors, and the opened or closed position of the switches is held by permanent magnets; comprising:

a spring compressing shaft which is moved to the axial direction by the rotation of a handle to exert a spring repulsion force enough to overcome the magnetic pull-in force from the permanent magnet;

a rotating shaft which is engaged to the spring compressing shaft so that the driving force by the handle is transmitted to the spring compressing shaft and the spring compressing shaft is movable to the axial direction within the predetermined span; and a housing which houses the spring compressing shaft and the rotating shaft with the both shafts being connected to the magnetic operating mechanism, wherein the spring compressing shaft and the rotating shaft are in a position spaced from each other when a springs are compressed by the rotation of the handle, in a position close to each other when the repulsion force of the springs exceeds the magnetic pull-in force from the permanent magnet.

8. A manual tripping device for the magnetic operating mechanism according to claim 7, wherein the spring compressing shaft has a hole for inserting the rotating shaft in which an elongate hole extending to the axial direction is cut through, a pin being provided in the hole of the spring compressing shaft through the elongate hole, thereby the spring compressing shaft and the rotating shaft being engaged movably within the span of the elongate hole.

9. A manual tripping device for the magnetic operating mechanism according to claim 7, around the spring compressing shaft, further comprising:

a conical spring which is compressed by the rotation of the handle and having a spring tension enough to exceed the magnetic pull-in force from the permanent magnet; and a coil spring which absorbs the repulsion force of the spring compressing shaft caused by a collision.

* * * * *